US007380429B1

(12) United States Patent
Ghiran et al.

(10) Patent No.: US 7,380,429 B1
(45) Date of Patent: Jun. 3, 2008

(54) TUBULAR LOCAL EXPANSION APPARATUS AND METHOD OF LOCALLY EXPANDING TUBULAR MEMBER FOR VEHICLES

(75) Inventors: Mike M. Ghiran, Lake Orion, MI (US); Sanjay M. Shah, Troy, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 11/680,139

(22) Filed: Feb. 28, 2007

(51) Int. Cl.
*B21D 22/12* (2006.01)
*B21D 51/00* (2006.01)

(52) U.S. Cl. ..... 72/58; 72/61; 72/62; 72/370.22; 72/63; 29/421.1

(58) Field of Classification Search ..... 72/56, 72/57, 58, 61, 62, 63, 370.22; 29/421.1
See application file for complete search history.

(56) References Cited

U.S. PATENT DOCUMENTS

| | | | | |
|---|---|---|---|---|
| 2,821,945 | A * | 2/1958 | Peccerill | 72/62 |
| 2,997,093 | A * | 8/1961 | Harris | 72/63 |
| 3,043,254 | A * | 7/1962 | Heidmann | 72/20.5 |
| 3,397,563 | A * | 8/1968 | Pelton | 72/62 |
| 3,698,337 | A * | 10/1972 | Brawner et al. | 72/58 |
| 3,757,555 | A * | 9/1973 | Blutt et al. | 72/63 |

* cited by examiner

*Primary Examiner*—David B Jones

(57) ABSTRACT

An apparatus and method for locally expanding tubular member includes a pre-form die having a cavity with an expansion chamber therein to receive a portion of a tubular blank between ends thereof. The apparatus also includes a bladder apparatus for insertion in the tubular blank and cooperating with the pre-form die to locally expand the portion of the tubular blank in the expansion chamber to form a locally expanded tubular member.

7 Claims, 7 Drawing Sheets

TUBULAR LOCAL EXPANSION APPARATUS AND METHOD OF LOCALLY EXPANDING TUBULAR MEMBER FOR VEHICLES

TECHNICAL FIELD

The present invention relates generally to vehicles and, more specifically, to an apparatus for local expansion of a tubular member and a method of locally expanding a tubular member for a vehicle.

BACKGROUND OF THE INVENTION

It is known to construct tubular members for vehicles such as automotive vehicles. The tubular members are typically roll-formed and/or extruded from steel, aluminum, or magnesium and have a constant wall thickness. However, it is occasionally desirable to have a tubular member that has an increased stiffness, wherein the stiffness is increased away from the ends of the tubular member.

It is also known that rollformers or tailored tube producers have made steel tubular members with increased stiffness around the perimeter of the tubular member. To increase the stiffness, strips of metal have been welded together axially prior to joining the strips into a tubular form. However, these tubular members are costly due to the extra material and labor involved.

It is known to hydroform tubular components or members. Hydroformed tubular members are becoming increasingly popular in automotive body structural applications. During vehicle body manufacturing, many of the hydroformed tubular members are used in vehicle body and chassis applications. However, vehicle strength, stiffness, and/or impactworthiness often necessitate the need for local areas of structural reinforcement to meet their design goals.

As a result, it is desirable to provide an apparatus for locally expanding a tubular member or blank to achieve a desirable stiffness where needed for a structural member of a vehicle. It is also desirable to provide a hydroformed tubular member having a local expansion away from the ends of the tubular member for a structural member of a vehicle. It is further desirable to provide a method for locally expanding a tubular member away from the ends of the tubular member. Therefore, there is a need in the art to provide a new cost effective apparatus and method that meets at least one of these desires.

SUMMARY OF THE INVENTION

Accordingly, the present invention is an apparatus for locally expanding a tubular member. The apparatus includes a pre-form die having a cavity with an expansion chamber therein to receive a portion of a tubular blank between ends thereof. The apparatus also includes a bladder apparatus for insertion in the tubular blank and cooperating with the pre-form die to locally expand the portion of the tubular blank in the expansion chamber to form a locally expanded tubular member.

Additionally, the present invention is a method for locally expanding a tubular member for a vehicle. The method includes the steps of providing a tubular blank and positioning a bladder apparatus inside of the tubular blank between ends thereof. The method also includes the steps of supplying fluid to the bladder apparatus and locally expanding the tubular blank between the ends thereof into a locally expanded tubular member having a locally expanded portion between the ends thereof.

DESCRIPTION OF THE PREFERRED EMBODIMENT

Figure 1:
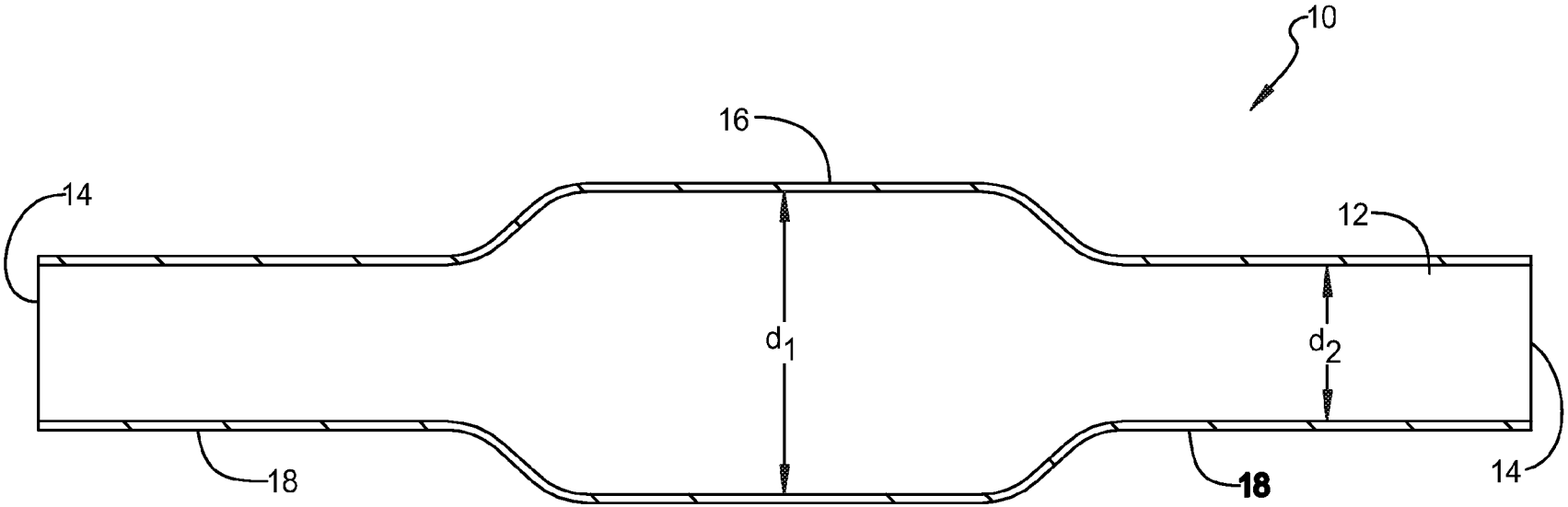
FIG. 1 is a fragmentary elevational view of a locally expanded tubular member, according to the present invention.

Referring to the drawings and in particular FIG. 1, one embodiment of a locally expanded tubular member 10, according to the present invention, is generally shown for a vehicle (not shown). In the embodiment illustrated in FIG. 1, the locally expanded tubular member 10 extends axially and has a closed cross-section. In the embodiment illustrated, the locally expanded tubular member 10 is a tube having a generally circular cross-sectional shape. The locally expanded tubular member 10 has a generally arcuate shaped wall 12 forming a closed perimeter. The wall 12 extends axially and has open axial ends 14. The wall 12 has at least one expanded portion 16 disposed between the axial ends 14. The expanded portion 16 has a diameter ($d_1$) greater than a diameter ($d_2$) of remaining portions 18 along the perimeter thereof to form the locally expanded tubular member 10. The diameter of the wall 12 varies between diameters ($d_1$) and ($d_2$). The locally expanded tubular member 10 is made of a metal material with good elongation properties such as steel, aluminum, or other suitable materials. The locally expanded tubular member 10 is formed by an apparatus 20 and method to be described. It should be appreciated that the locally expanded tubular member 10 is a monolithic structure being integral, unitary, and one-piece. It should also be appreciated that the locally expanded tubular member 10 may be defined as having a variable diameter with a closed circular cross-section.

Figure 2:
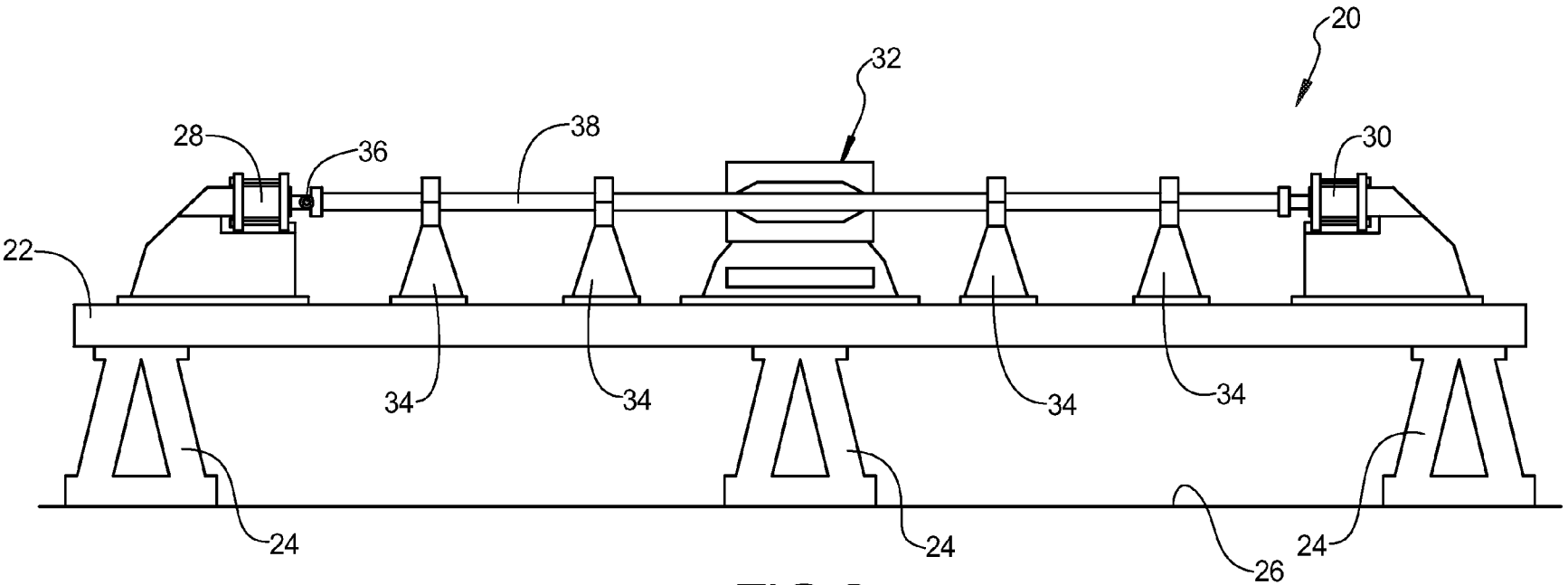
FIG. 2 is an elevational view of an apparatus, according to the present invention, for locally expanding a tubular member to make the locally expanded tubular member of FIG. 1.

Referring to FIG. 2, one embodiment of an apparatus 20, according to the present invention, is shown for making the locally expanded tubular member 10. The apparatus 20 includes a mounting platform 22 extending axially and at least one, preferably a plurality of supporting legs 24 supporting the mounting platform 22 above a support surface 26. The apparatus 20 also includes at least one, preferably a plurality of pusher cylinders supported by the mounting platform 22. In the embodiment illustrated, the pusher cylinders include an inner pusher cylinder 28 and an outer pusher cylinder 30 spaced axially from each other. The apparatus 20 includes at least one pre-form die, according to the present invention and generally indicated at 32, supported by the mounting platform 22 and disposed between and spaced from the pusher cylinders 28 and 30. The apparatus 20 further includes at least one, preferably a plurality of tube supports 34 supported by the mounting platform 22 and disposed between and spaced from the pre-form die 32 and pusher cylinders 28 and 30. The apparatus 20 also includes a forming fluid inlet 36 disposed between the inner pusher cylinder 28 and a tubular blank 38 disposed in the apparatus 20 and supported by the pusher cylinders 28,30, pre-form die 32, and tube supports 34. It should be appreciated that the tubular blank 38 is used to form the locally expanded tubular member 10 previously described.

Figures 3, 3A, 3B:
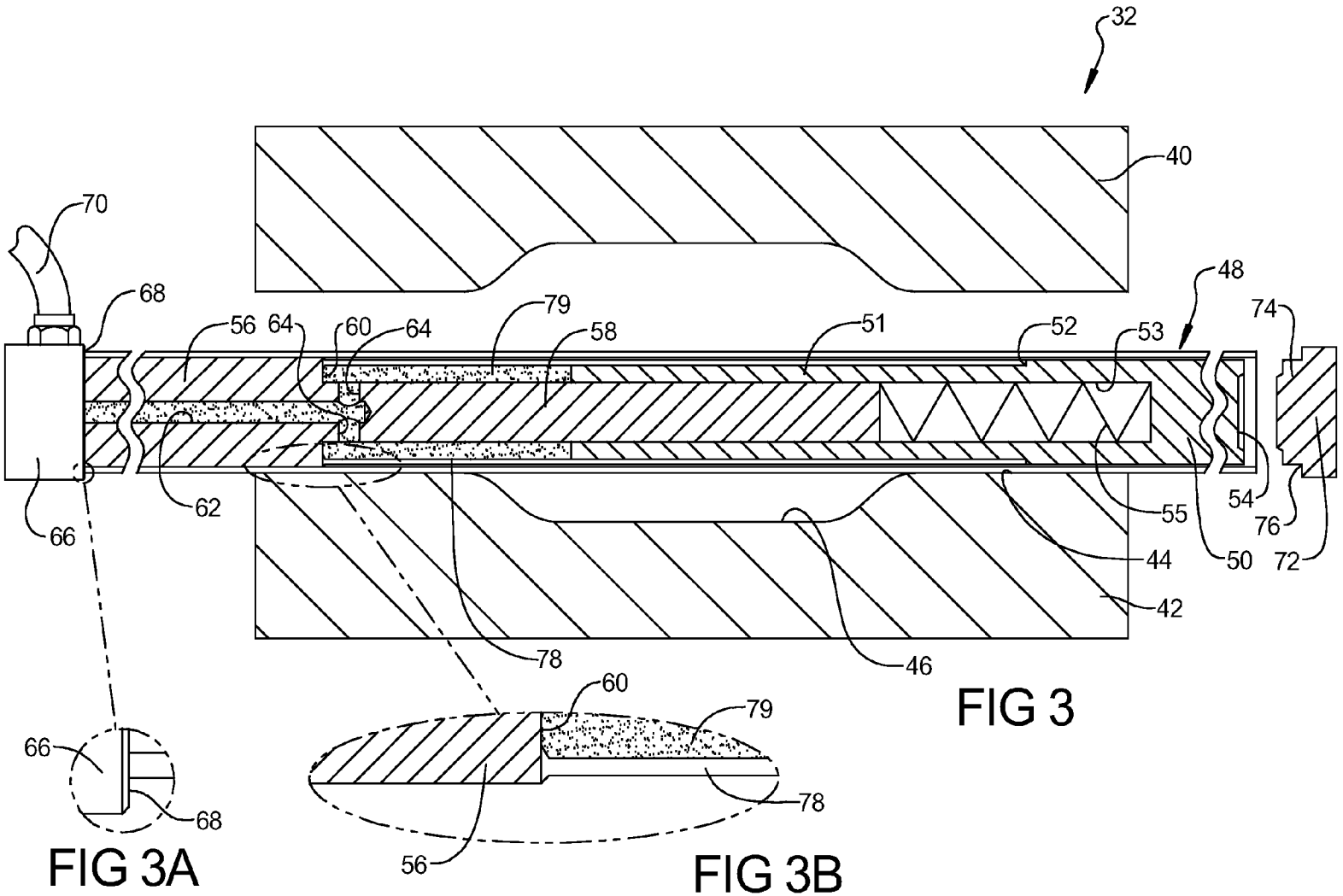
FIGS. 3, 3A, and 3B are enlarged fragmentary views of a portion of the apparatus of FIG. 2 illustrating a first step of a method, according to the present invention, for locally expanding a tubular member.

Referring to FIGS. 3, 3A, and 3B, one embodiment of the pre-form die 32 is shown. The pre-form die 32 includes an upper die half 40 and a lower die half 42. The pre-form die 32 has a cavity 44 extending axially into the die halves 40 and 42 receiving a portion of the tubular blank 38. The pre-form die 32 also has an expansion chamber 46 extending radially from the cavity 44 and into the die halves 40 and 42. The expansion chamber 46 has a generally circular cross-sectional shape. It should be appreciated that the expansion chamber 46 has a predetermined expansion. It should also be appreciated that, although the expansion chamber 46 is illustrated as circular in cross-sectional shape, the expansion chamber 46 may have any other suitable configuration. It should further be appreciated that the die halves 40 and 42 are operated or moved using clamping devices (not shown).

The apparatus 20 also includes a bladder apparatus, generally indicated at 48, that is inserted into the tubular blank 38 after the tubular blank 38 is loaded into the pre-form die 32. The bladder apparatus 48 extends inside the tubular blank 38 from one end to another. The bladder apparatus 48 includes an outer pusher 50 extending axially and having an end portion 51 extending axially. The end portion 51 has a diameter less than a diameter of the outer pusher 50 to form a shoulder 52. The outer pusher 50 has a cavity 53 extending axially into one end of the end portion 51. The outer pusher 50 also has a cavity 54 extending axially therein from the other end thereof for a function to be described.

The bladder apparatus 48 also includes a spring 55 disposed in the cavity 53 of the outer pusher 50 for a function to be described. The bladder apparatus 48 includes an inner pusher 56 partially disposed in the cavity 53 of the outer pusher 50. The inner pusher 56 extends axially and has an end portion 58 extending axially to be disposed in the cavity 53 and contact the spring 55. The end portion 58 has a diameter less than a diameter of the inner pusher 56 to form a shoulder 60. The inner pusher 56 has a passageway 62 extending axially therein and at least one, preferably a plurality of outlet ports 64 extending radially from the passageway 62 and through the end portion 58 to supply fluid to a forming fluid chamber to be described. The inner pusher 56 has an end pusher portion 66 at the end opposite the end portion 58. The end pusher portion 66 has a diameter greater than a diameter of the inner pusher 56 to form an end feeding shoulder 68. It should be appreciated that passageway 62 extends through the end pusher portion 66 and a conduit 70 is attached to the end pusher portion 66 and communicates with the passageway 62 to supply fluid thereto.

The bladder apparatus 48 also includes an end pusher 72 that cooperates with the outer pusher 50 and the outer pusher cylinder 30. The end pusher 72 has an end portion 74 extending axially to be disposed in the cavity 54 of the outer pusher 50. The end portion 74 has a diameter less than a diameter of the end pusher 72 to form an end feeding shoulder 76. It should be appreciated that the cavity 54 of the outer pusher 50 accepts the end portion 74 of the end pusher 72 for pushing the tubular blank 38 and the outer pusher 50 in a manner to be described.

The bladder apparatus 48 further includes a flexible bladder 78 disposed over a portion of the inner pusher 56 and outer pusher 50 to form a forming fluid chamber 79 therebetween. The flexible bladder 78 is generally tubular in shape and has one axial end abutting the end feeding shoulder 68 of the inner pusher 56 and another axial end abutting the shoulder 52 of the outer pusher 50. It should be appreciated that the spring 55 keeps the flexible bladder 78 stretched during insertion of the bladder apparatus 48 inside of the tubular blank 38.

Referring to FIGS. 3 through 7, one embodiment of a method, according to the present invention, for locally expanding a tubular member for assembly in automotive structures (not shown) of a vehicle (not shown). The method includes the step of providing a metal tubular member or blank 38. In this embodiment, the tubular blank 38 is a circular tube extending axially and having a wall 39 with a uniform wall thickness. The method includes the step of placing or disposing the tubular blank 38 in at least one pre-form die 32. It should be appreciated that more than one pre-form die 32 may be used and that the pre-form dies 32 exist only at the locations where expansions of the tubular blank 38 are needed. It should also be appreciated that the rest of the tubular blank 38 is disposed in the apparatus 20 and supported by the tube supports 34 and pusher cylinders 28 and 30 as illustrated in FIG. 2.

Figure 4:
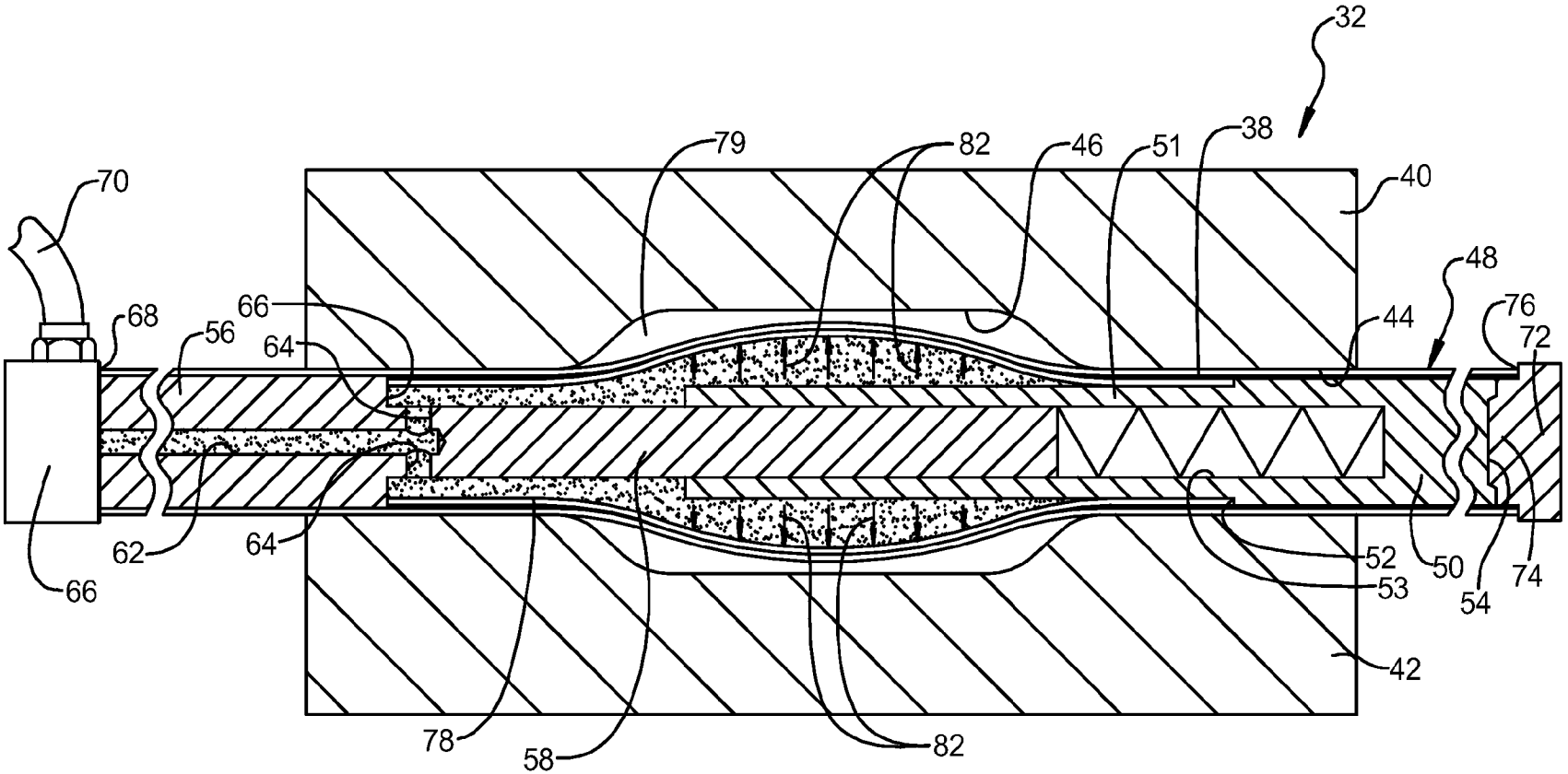
FIG. 4 is a view similar to FIG. 3 illustrating a second step of the method for locally expanding a tubular member.

The method includes the step of filing the bladder apparatus 48 with fluid and inserting the bladder apparatus 48 inside of the tubular blank 38. As illustrated in FIG. 3, fluid flows from the conduit 70 through the passageway 62 and outlet ports 63 and into the forming fluid chamber 79 to keep the flexible bladder 78 stretched for insertion into one end of the tubular blank 38. The method also includes the steps of closing the die halves 40 and 42 upon one another with the tubular blank 38 being enclosed between the die halves 40 and 42 as illustrated in FIG. 4.

Once the die 32 is closed, the method includes the step of engaging the end pusher 72 with the outer pusher 50 and the tubular blank 38. The method includes the step of increasing the fluid pressure inside the flexible bladder 72 to expand the flexible bladder 72 and a local portion of the tubular blank 38 as illustrated by the arrows 82 in FIG. 4. The method includes the step of moving or feeding the inner pusher 56 and outer pusher 50 toward each other by the pusher cylinders 28 and 30, respectively, in combination with increasing the pressure in the forming fluid chamber 79.

Figure 5:
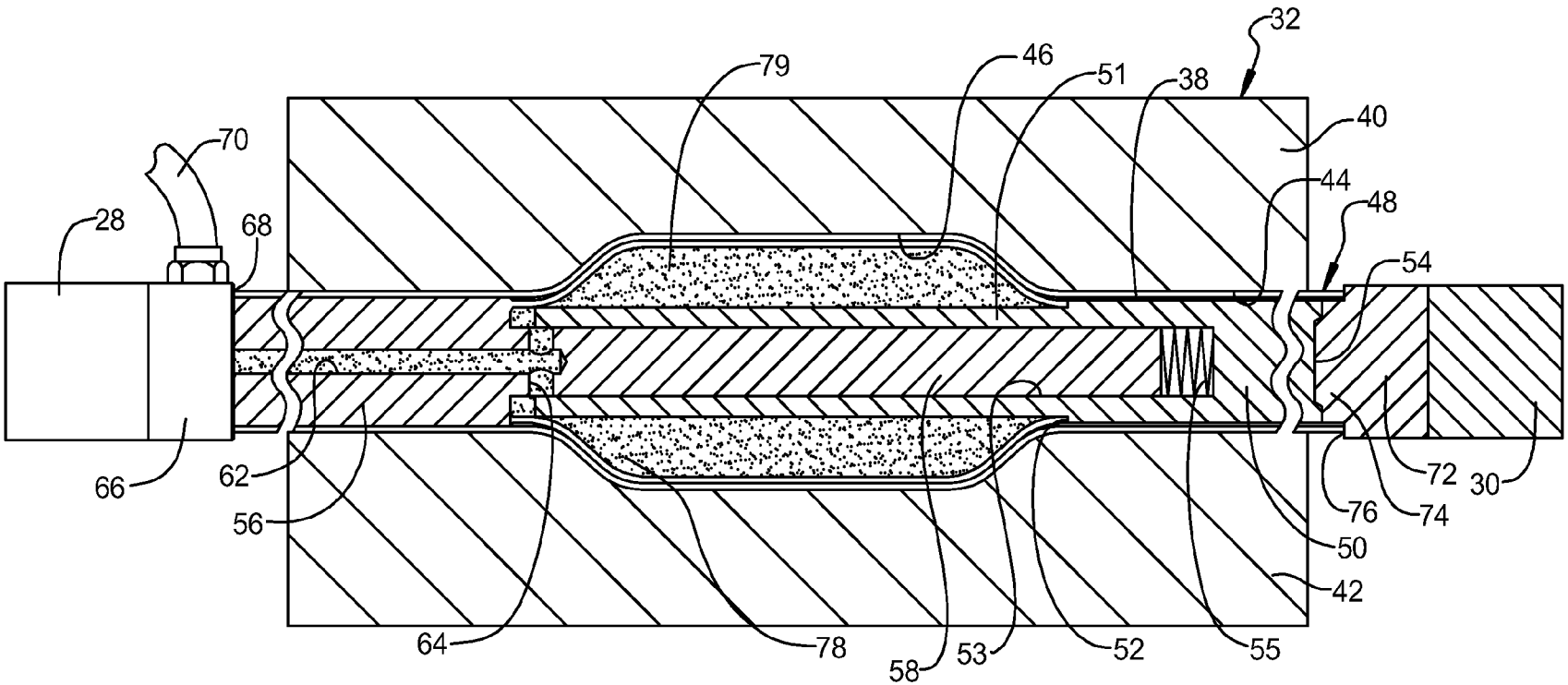
FIG. 5 is a view similar to FIG. 3 illustrating a third step of the method for locally expanding a tubular member.

Referring to FIG. 5, the method includes the step of further increasing the fluid pressure inside the flexible bladder 72 to expand the flexible bladder 72 and the local portion of the tubular blank 38 to a final cross-sectional profile of the expansion chamber 46 by increasing the hydraulic pressure sufficient to exceed the yield limit of the tubular blank 38 so that the tubular blank 38 is forced into conformity with the expansion chamber 46 of the die halves 40 and 42. It should be appreciated that, while the pressure is increasing in the flexible bladder 78, both the inner and outer pushers 56 and 50, respectively, are activated (pushed) towards the center of the cavity 44. It should also be appreciated that this allows the tube to be drawn towards the center of the expansion chamber 46. It should further be appreciated that this is equivalent to feeding the material to carry out the expansion (due to increase in pressure) and due to feeding of the tube material in the expansion chamber 46 until final tube expansion is achieved.

Figure 6:
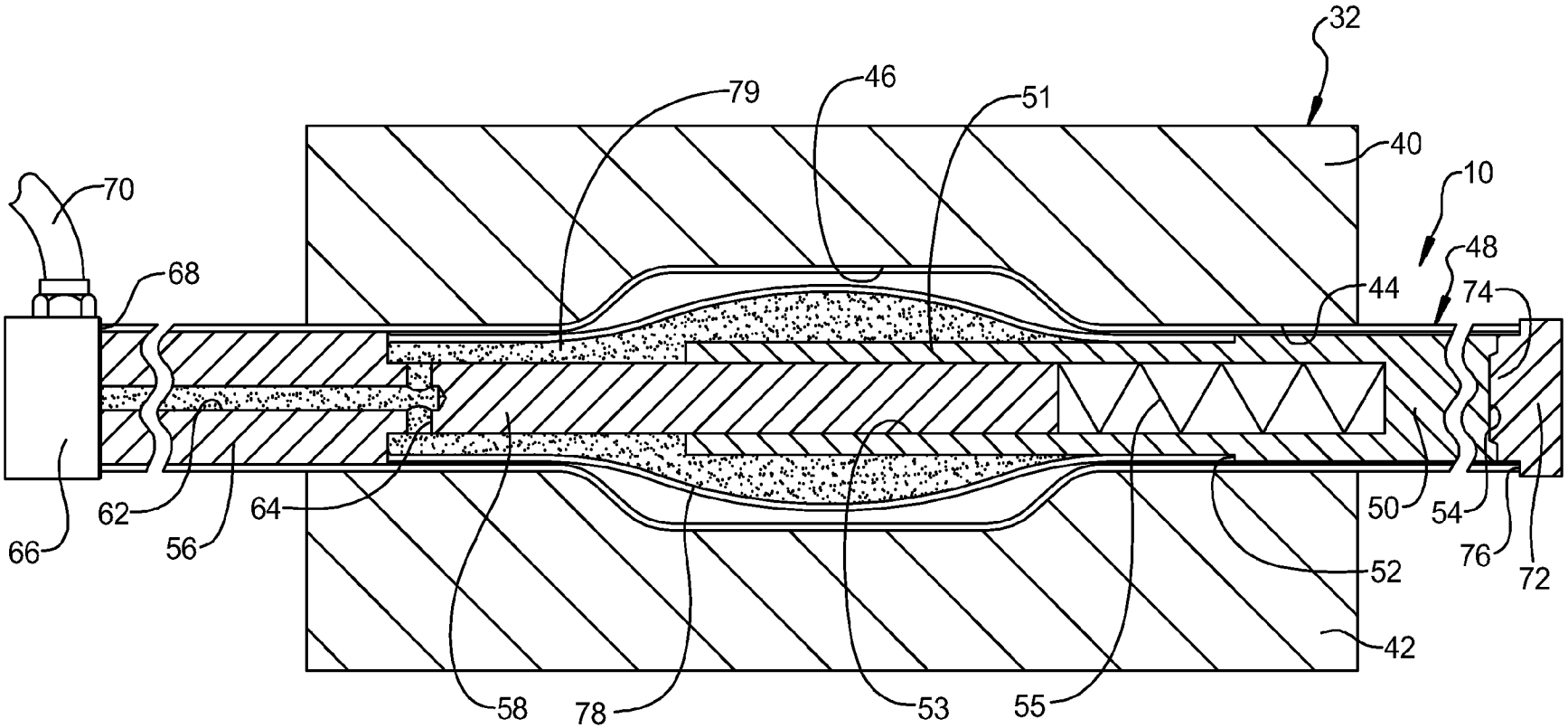
FIG. 6 is a view similar to FIG. 3 illustrating a fourth step of the method for locally expanding a tubular member.
Figure 7:
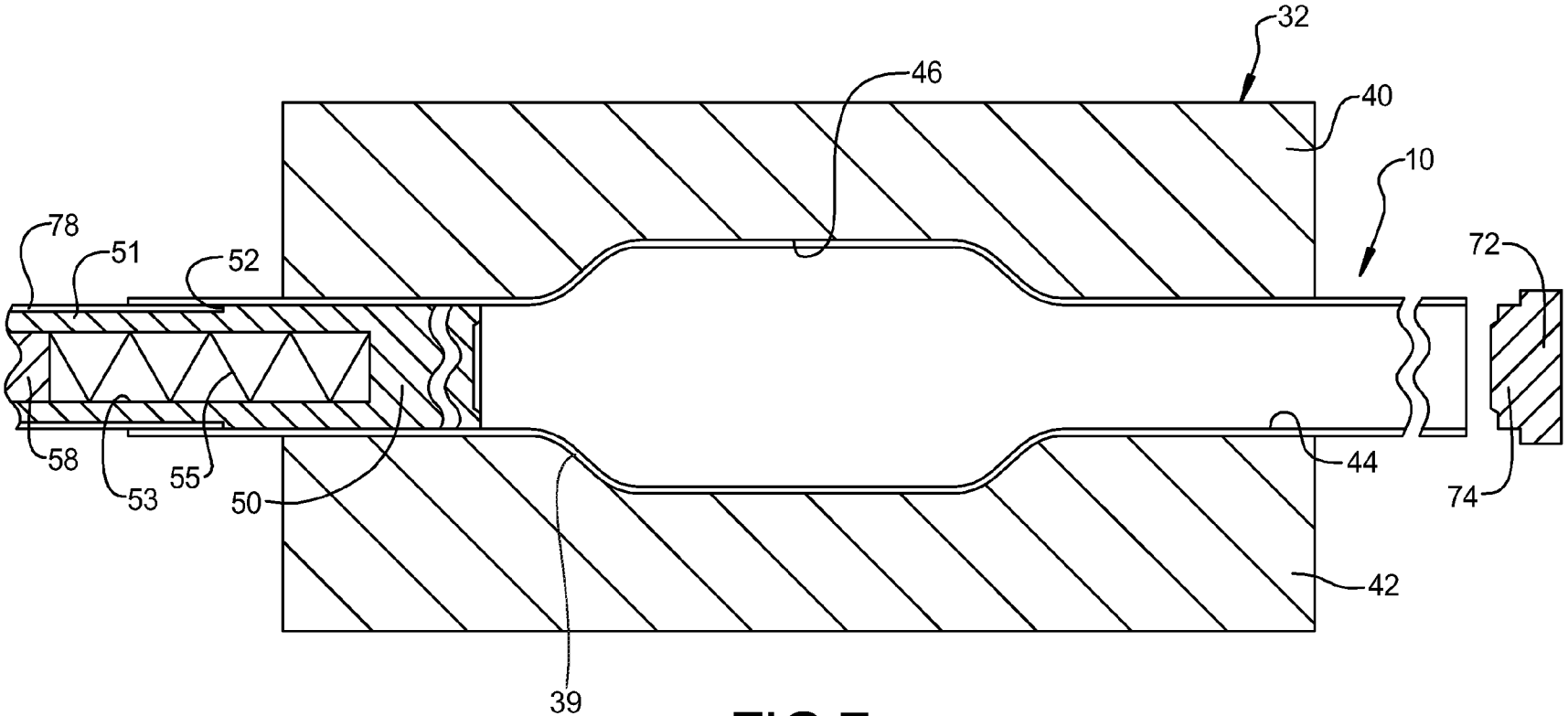
FIG. 7 is a view similar to FIG. 3 illustrating a fifth step of the method for locally expanding a tubular member.

Referring to FIG. 6, the method includes the step of releasing the pressure in the flexible bladder 78 and allowing the flexible bladder 78 to collapse. The method includes the step of moving the end pusher 72 and the inner pusher 56 outward simultaneously. This will then allow the spring 55 to straighten out the flexible bladder 78. The method includes the step of removing the bladder apparatus 48 from the locally expanded tubular member 10 as illustrated in FIG. 7.

The method includes the step of opening the die halves 40 and 42 to permit removal of the finished or locally expanded tubular member 10 from the die halves 40 and 42. The locally expanded tubular member 10 may be assembled into a vehicle body (not shown) or some other desired vehicle component. It should be appreciated that if more areas of expansion are needed, the bladder apparatus 48 is repositioned to different expansion locations of the locally expanded tubular member 10.

Accordingly, the present invention is an apparatus 20 and method for locally expanding a tubular member for a vehicle away from the ends of the tubular member. The apparatus 20 and method produces hydroformed structural members with locally expanded areas having reduced weight. The apparatus 20 and method provides higher expansion at desired locations on the tubular member. The apparatus 20 and method provides better performance of the tubular member by providing bigger sections, thereby increasing stiffness. The apparatus 20 and method eliminates additional parts for joining. The apparatus 20 and method reduces mass of the tubular member.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

The invention claimed is:

1. An apparatus for locally expanding tubular member comprising:

a pre-form die having a cavity with an expansion chamber therein to receive a portion of a tubular blank between ends thereof;

a bladder apparatus for insertion in the tubular blank and cooperating with said pre-form die to locally expand the portion of the tubular blank in said expansion chamber to form a locally expanded tubular member, said bladder apparatus having an inner pusher, an outer pusher, and a flexible bladder extending between the inner pusher and the outer pusher; and, an inner pusher cylinder cooperating with the inner pusher to push the inner pusher, and an outer pusher cylinder cooperating with the outer pusher to push the outer pusher.

2. An apparatus as set forth in claim 1 including at least one tube support disposed between said pre-form die and said inner pusher and said outer pusher to support the tubular blank.

3. An apparatus as set forth in claim 1 wherein said outer pusher has an end portion extending axially and has a pusher cavity extending axially therein.

4. An apparatus as set forth in claim 3 wherein said inner pusher has an end portion extending axially and being at least partially disposed in said pusher cavity.

5. An apparatus as set forth in claim 4 including a spring disposed in said pusher cavity between said end portion of said inner pusher and an end of said cavity.

6. An apparatus as set forth in claim 4 wherein said flexible bladder is disposed over said end portion of said inner pusher and said end portion of said outer pusher and spaced radially therefrom to form a forming fluid chamber.

7. A method for locally expanding a tubular member, said method comprising the steps of:

providing a tubular blank;

providing a die set having a first die half and a second die half with a cavity and an expansion chamber extending outwardly from the cavity to receive a portion of the tubular blank;

providing a bladder apparatus having an inner pusher, an outer pusher, and a flexible bladder extending between the inner pusher and outer pusher;

positioning the bladder apparatus inside of the tubular blank between ends thereof;

placing the portion of the tubular blank in the cavity;

closing the first die half and the second die half together;

supplying fluid to the bladder apparatus and moving the inner pusher and outer pusher toward each other; and locally expanding the tubular blank between the ends thereof into a locally expanded tubular member having a locally expanded portion between the ends thereof.

* * * * *